US006449892B1

(12) United States Patent
Jenkins

(10) Patent No.: US 6,449,892 B1
(45) Date of Patent: Sep. 17, 2002

(54) SMART WEAPON

(75) Inventor: Michael D. Jenkins, Burke, VA (US)

(73) Assignee: Xybernaut Corporation, Fairfax, VA (US)

( * ) Notice: Subject to any disclaimer, the term of this patent is extended or adjusted under 35 U.S.C. 154(b) by 0 days.

(21) Appl. No.: 09/883,877

(22) Filed: Jun. 18, 2001

(51) Int. Cl.[7] ..... F41A 9/53

(52) U.S. Cl. ..... 42/1.01; 42/106; 42/111; 89/41.01; 89/41.17; 89/1.11

(58) Field of Search ..... 89/41.01, 41.02, 89/41.03, 41.06, 41.07, 41.08, 41.17, 1.11, 1.1; 42/1.01, 111, 106

(56) References Cited

U.S. PATENT DOCUMENTS

| | | | | |
|---|---|---|---|---|
| 4,949,089 A | | 8/1990 | Ruszkowski et al. | 342/52 |
| 5,436,857 A | | 7/1995 | Nelson et al. | 361/686 |
| 5,448,847 A | | 9/1995 | Teetzel | 42/70.11 |
| 5,471,213 A | * | 11/1995 | Hergesheimer | 89/1.11 |
| 5,570,528 A | | 11/1996 | Teetzel | 42/70.11 |
| 5,587,904 A | * | 12/1996 | Ben-Yair et al. | 434/14 |
| 5,608,608 A | | 3/1997 | Flint | 342/52 |
| 5,675,112 A | | 10/1997 | Giry et al. | 89/41.06 |
| 5,735,070 A | | 4/1998 | Vasquez et al. | 42/1.02 |
| 5,826,360 A | | 10/1998 | Herold et al. | 42/1.02 |
| 5,844,824 A | * | 12/1998 | Newman et al. | 345/156 |
| 5,864,481 A | | 1/1999 | Gross et al. | 364/400 |
| 5,918,304 A | * | 6/1999 | Gartz | 42/1.01 |
| 5,999,952 A | | 12/1999 | Jenkins et al. | 708/100 |
| 6,029,183 A | | 2/2000 | Jenkins et al. | 708/100 |
| 6,216,185 B1 | | 4/2001 | Chu | 710/101 |
| 6,219,952 B1 | | 4/2001 | Mossberg et al. | 42/70.01 |

FOREIGN PATENT DOCUMENTS

| | | |
|---|---|---|
| WO | WO92/18924 | 10/1992 |
| WO | WO96/01404 | 1/1996 |

* cited by examiner

*Primary Examiner*—J. Woodrow Eldred
(74) *Attorney, Agent, or Firm*—James J. Ralabate

(57) ABSTRACT

There is described a smart weapon system including a weapon which serves as an enclosure to a transferable core computer. The computer provides the operator of the weapon the advantages of having an integrated computer/communications platform contained within the weapon and thus reducing the burden placed on the operator to carry multiple and distinct computer/communication devices.

8 Claims, 2 Drawing Sheets

SMART WEAPON

TECHNICAL FIELD

The present invention is directed to the field of computers and computer enclosures in the form of weaponry. Specifically, the invention is the incorporation of a transferable core computer into a gun.

BACKGROUND ART

Modern technology, especially computers and electronics, has advanced rapidly in the recent past. Accordingly, it would be advantageous to apply these technological advances to the art of war, law enforcement, and gun safety. More particularly, it would be advantageous to apply the technological advances to weapons and other equipment designed to help the modern soldier or law enforcement officer function better in battlefield and tactical situations and increase their chances for survival.

The conventional method of providing a soldier with modern technology, such as a computer, communications equipment and a Global Positioning System (GPS) is to have him carry individual devices. This equipment in combination with a soldier's weapon and armor can easily weigh over 70 pounds, which can create stress on the soldier and reduce his mobility. For example, in U.S. Pat. No. 5,864,481, Gross et al discloses a modular soldier-centered fighting system comprising an enhanced vision, communications, weapons and control interface system. The core of the system is a modular compact computer which is wired to a ballistic helmet with a modular heads-up display which provides remote viewing via a thermal weapons site, weapon mounted video camera, helmet mounted night-vision image intensifier, laser detection system and a GPS receiver. The system includes individual radios for soldier-to-soldier communication to Command Center(s). The weapons subsystem, which is integrated with the computer/radio subsystem and helmet, includes a modular weapon, a thermal weapon sight, video camera and laser range finder/digital compass assembly. However, the computer, radios and other electrical components are mounted within a backpack worn by the soldier which creates an additional burden on the wearer.

In U.S. Pat. No. 5,675,112, Giry et al discloses a device for the localizing and restoring of a line of fire of a weapon carried by a shooter equipped with a helmet. The device is comprised of two cameras, a first camera mounted on the helmet and the second camera being mounted on the weapon. A computer that receives digitized information from each camera, and which aids in the direction of fire of the weapon, is carried by the shooter. Again, an additional burden is placed on the shooter by carrying the computer.

In U.S. Pat. No. 4,949,089, Ruszkowski, Jr. discloses a portable target locator system which comprises a rifle-like target locator and a transmitter/modem capable of transmitting target location coordinates to a weapons delivery system. The rifle-like target locator comprises a day and/or night magnifying optics/sighting system, GPS receiver and processor, azimuth and elevation sensor, a data entry keypad, laser rangefinder, and a microprocessor. The microprocessor calculates the coordinates of a selected target based upon the observer's coordinates, as determined by the GPS system and the laser rangefinder, and the range, azimuth and elevation data of the target relative to the position of the target locator. The target data then may be transmitted to an appropriate weapons delivery system, such as a tactical aircraft, or stored in onboard non-volatile memory for later analysis. However, this target locator system is not a functioning weapon. Therefore, the operator of this system would need to carry an additional piece of equipment; i.e., a gun, for engaging the enemy. Moreover, the microprocessor unit is not modular and therefore can not be customized for the specific task of the user.

In WO 96/01404, Michel et al discloses a weapon with a sight in which a computer controls a collimated reticle to move it onto the future point of impact between a target and a projectile fired from the weapon. The reticle consists of a lines-drawing means continuously movable by means of electrical units that receive control inputs from the computer, and the computer is provided with an electrical input control program for imperceptibly moving the reticle onto the future point of impact and locking it on. Again, the computer as disclosed is neither modular nor removable; therefore, it can not be customized for the specific task of the user.

Transferable core computers are known in the art such as the computers described in commonly assigned U.S. Pat. Nos. 5,999,952 and 6,029,183. The disclosure of these two patents is hereby incorporated by reference into the present disclosure, for the purposes of this disclosure, and claims the term "transferable core computer", "core", "core computer module" or "core module" will be used interchangeably and will be taken to mean a computer system such as is disclosed in these patents. The core unit has preferably only one uniquely configured connecting means which mates with or fits against a reciprocal connector source or activating means in an enclosure. Other than this connecting means, all of the components of the core unit are sealed and not removable from the core housing. This same connecting means provides communication or transfer of information as well as power between the enclosure and the core module. In the core unit all of the computer components stay intact unlike the prior art where for example the CPU is removed and replaced with a second CPU or other components. The security offered by the core unit is provided by uniquely structured mating connection means which connect to a mate connector in the enclosure. In the event that the core unit is lost or misplaced, it's data cannot be used, read or printed out by others because it can only be activated by connection to an equally unique mating connector in the enclosure. There are many different unconventional connectors that can be used such as specially configured tongue and groove connectors, dove tail connectors, bar connectors, slot and projection connectors, etc. The more unique the communication or connectors, the better the security of the core unit. Obviously, any other security means may be incorporated into the system of this invention if desirable to further enhance the security of the system. Also for security reasons, the core unit is in a completely closed housing so that no computer component may be removed, copied or tampered with.

The transferable and removable standardized core computer unit includes a single housing comprising therein standard features of a self-contained general purpose computer. The enclosure unit has at least one electrical connector means for connection to a bus connection and to a source of power outside the enclosure. It will only work off the source of power provided by or through an enclosure and will not function as a stand-alone unit if directly attached to a power source. The enclosure comprises peripheral connector ports or devices to cooperate with said core computer unit when said core unit is placed therein, and the core computer unit has means to cooperate with a plurality of different enclosures when inserted into said enclosures in either an original placement or transferred from another enclosure. When more powerful computing is needed, the core computer can be upgraded be replacing the slower core computer with a faster one. Also, when additional features are desired such as voice recognition, a core with an integrated DSP may be used. The core computer unit has activation cooperation means for interaction with the desired activation means. The activation means are selected from the group consisting of audio activation means, communication activation means, pen activation means, brain activation means, eye-tracking activation means, mouse activation means, a keyboard activation means and mixtures thereof. The core unit has no removable components and will not function as a computer without said enclosure.

Also, disclosing core-like computers is Chu in U.S. Pat. No. 6,216,185. In '185, a personal computer system is taught which comprises an attached computing module (ACM) that contains the core computing power and environment for a computer user and a peripheral console (PCON) that contains the power supply and primary input and output devices for the computer system. To form an operational computer, the ACM is coupled with the PCON.

By having the weapon act as the enclosure for the transferable core computer, the soldier would be able to perform functions such as laser range finding to locate and identify targets, ammunition counting, GPS and communications to platoon leaders as well as communication among users, while carrying only a single device, namely his weapon. Other features include the ability to control when a gun can be fired, provide quicker and more efficient Friend or Foe identification, and determine whether the person firing the weapon is authorized to fire, all of which are known in the art.

There are many discussions in the prior art concerning who is authorized to fire a weapon and how to identify a friend from a foe. For example, in U.S. Pat. No. 6,219,952, Mossberg et al discloses such a system where a passive identification tag is mounted to a personal adornment to be carried or worn by an individual and is preprogrammed with an authorized identification code. When the authorized tag is in proximity to the firearm, a signal is transmitted to the firearm causing an electrical activation circuit to provide power to a portable power supply to move a switch enabling use of the firearm. Other methods include U.S. Pat. No. 5,570,528 in which Teetzel discloses a voice activated locking apparatus for handguns and rifles where a verified speech pattern by a voice recognition chip unlocks a solenoid mechanism that allow the weapon to be fired. Moreover, Teetzel, in U.S. Pat. No. 5,448,847, discloses a lock and target authentication apparatus where a number of weapons can communicate with one another. If the weapon receives a preselectable infra red signal from another weapon, then the weapon knows that the other weapon is a "friend" and not a "foe."

Ammunition counting is also known in the art. In U.S. Pat. No. 5,826,360, Herold et al discloses an ammunition clip or magazine for a firearm including a self-contained system for sensing the amount of ammunition contained within the magazine and visually or audibly indicating the value to the users of the firearm. Moreover, Vasquez et al, in U.S. Pat. No. 5,735,070, discloses a low ammunition warning system including a detector and a circuit for tracking depletion of ammunition contained within the weapon. Visible and tactile signals, responsive to the circuit, warn the user when a known pre-set low ammunition count has been reached.

SUMMARY OF THE INVENTION

It is therefore an object of this invention to provide a weapon system which is devoid of the above mentioned shortcomings.

A further object of this invention to provide a novel computerized weapon system.

Another object of this invention is to provide a novel enclosure for the transferable core computer.

Still a further object of this invention is to integrate different functions that normally would be carried by the user within a weapon.

Yet a further object of this invention is to provide a novel computerized weapon that gives the user the ability to exchange computer modules.

Still a further object of this invention is to provide a novel computerized weapon that can fire projectiles without the core computer being docked in the weapon enclosure.

Another object of this invention is to provide a novel computerized weapon that can authenticate the user prior to the weapon's activation of the computerized functions.

These and additional objects of the present invention are accomplished generally by incorporating a transferable core computer into a gun, most generally into the buttstock for conventional shoulder fired weapon, but it could be anywhere in the weapon, attached, or docked to the weapon. The core computer has a single connector that mates with a reciprocal connector within the butstock. The core computer is surrounded by shock absorbing material built into the buttstock. Power and data are supplied through a single cable which is connected to the core computer through the buttstock at one end and connected to the user at the other. The user will carry a power supply, preferably in the form of rechargeable batteries. Alternatively, the batteries will be attached or built into the gun and/or the data will be transmitted wirelessly from the core computer to the user.

In the first embodiment of the instant invention, a rifle is the enclosure for the core computer. The computer when docked in the buttstock portion of the rifle provides the user the ability to monitor additional parameters and offer additional functions not available to the user with conventional weapons, such as laser range finding, to locate and identify targets, ammunition counting, GPS and communications to platoon leaders as well as communication among users. Other features include the ability to control when a gun can be fired, provide quicker and more efficient Friend or Foe identification, determine whether the person firing the weapon is authorized to fire or not, provide mapping data, or mission-specific data, etc. Each of these additional functions can be implemented in a variety of ways, which are known in the art. For example, the ability to control when a gun can be fired can be implemented using the methods described above or may be implemented using a smart card, a pin number, or biometrics such as voice or fingerprint identification.

In the event that the core computer becomes damaged or inoperative, the user need only swap out the corrupted core for a working one to regain the additional functionality. However, the gun need not have the core module present in order for it to fire.

In another embodiment of the instant invention, information can be added to the system while en-route to a mission. In this embodiment, the core is docked into a system that is carried on an airplane, or ground transport. This system would have the most up to date information regarding mapping data, terrain, and offer the most current situational awareness of the mission. When the soldier is about to depart the plane or transport, they remove their core from the transport's system and dock the core into their weapon.

In another embodiment of the instant invention, information can be extracted from the core computer to a central system after a completed mission. In this embodiment, the core is docked in the weapon while the soldier is engaged in a particular mission. Information is compile regarding enemy troop movements, position, size, armament, rounds fired, direction of fire, etc. and stored in the transferable core computer. When the soldier returns from the mission, the core is removed from the weapon and docked into a central computer enclosure, thereby providing current tactical information that may be useful to plan future missions.

In another embodiment of the instant invention, the transferable core computer can be swapped from the weapon enclosure to a pen tablet type enclosure, thus giving the user another interface with which to use the computer. Specifically, when the core computer is not being used for data collection in the weapon enclosure, it can be removed and docked into a pen tablet type enclosure giving the user the option of attaching different peripherals for a specific task, such as mission planning, email, games, etc.

The foregoing and additional objects and advantages of the invention together with the structure characteristics thereof, which is only briefly summarized in the foregoing passages, become more apparent to those skilled in the art upon reading the detailed description and preferred embodiments, which follow in this specification, taken together with the illustration thereof presented in the representative accompanying drawings.

DETAILED DESCRIPTION OF THE INVENTION AND PREFERRED EMBODIMENTS

Figure 1:
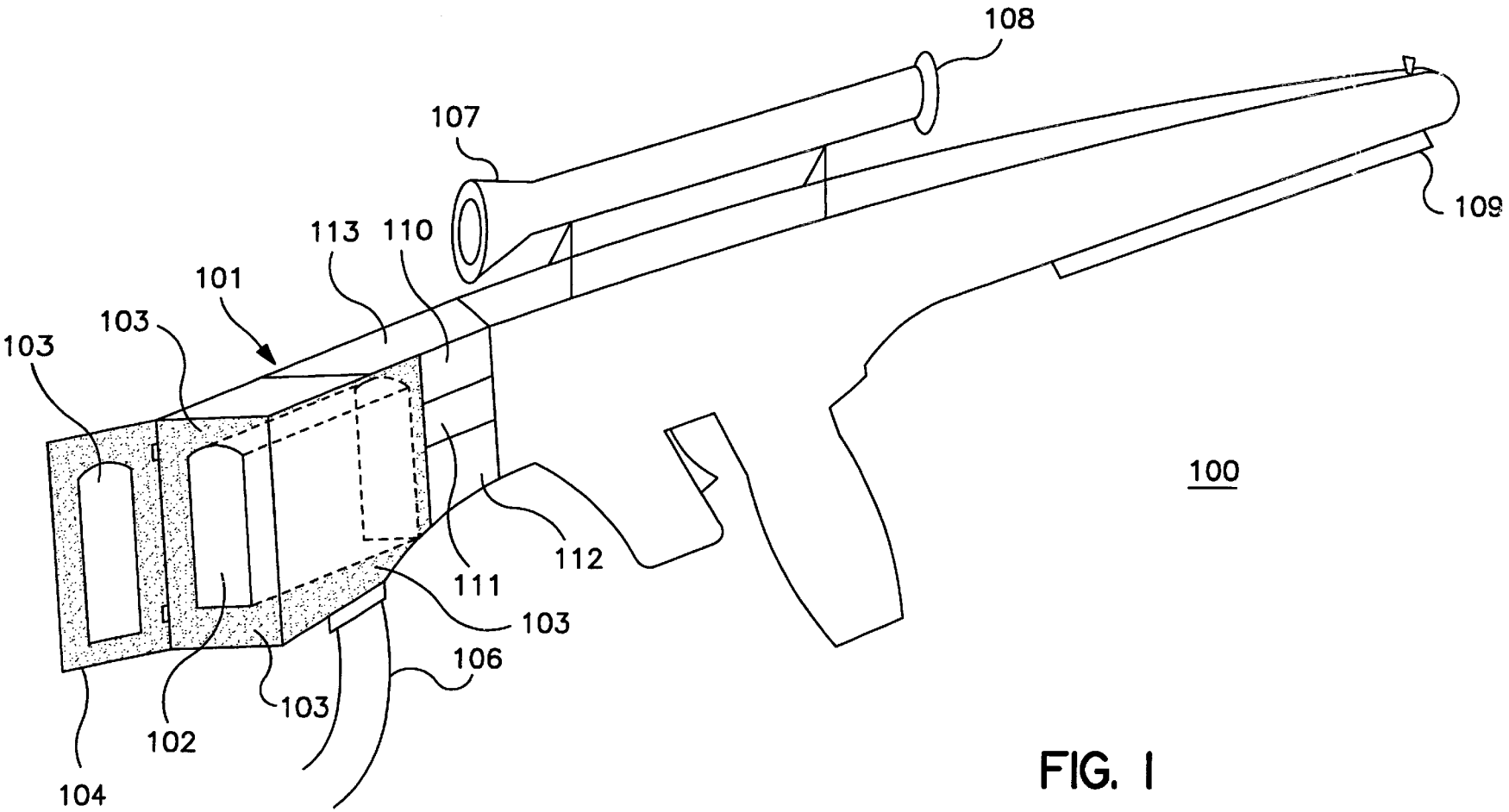
FIG. 1 illustrates the first embodiment of the instant invention comprising a transferable core computer enclosed within the buttstock of a gun.

Discussion of the invention will now be made with specific references to the drawing figures. FIG. 1 illustrates the first embodiment of the instant invention comprising a transferable core computer incorporated into the buttstock of a rifle indicated generally by reference number 100. The buttstock 101 is designed to enclose the core computer 102. Surrounding the enclosed core computer is a shock absorbing material 103, such as silicone or any other material with similarly desirable properties. A door 104 is attached to the buttplate 105. Preferably, the inside of the door is layered with a shock absorbing material to provide additional protection from the shock of recoil and general use to the core computer. Cable 106 connects the computer to other peripheral devices, such as a display, input device, and/or power supply. The rifle is equipped with additional features including day and/or night magnifying optics/sighting system 107, camera 108, laser rangefinder 109, GPS receiver/processor 110, azimuth and elevation sensor 111, keypad 112.

Figure 2:
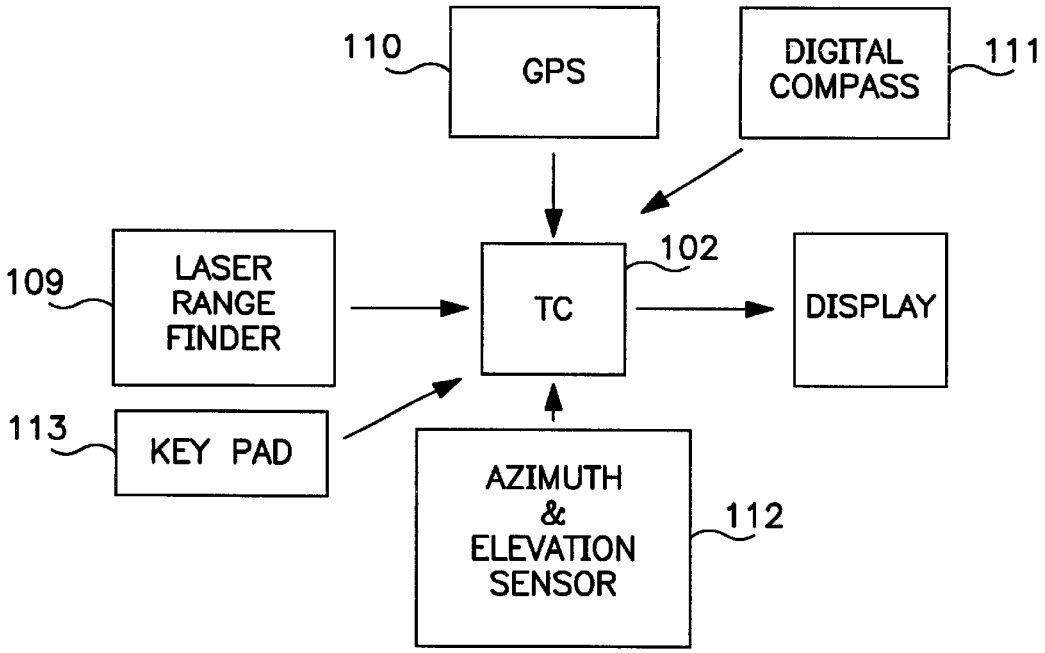
FIG. 2 illustrates a basic functional block diagram of the smart weapon system of the instant invention.

FIG. 2 illustrates a basic functional block diagram of the smart weapon system of the instant invention. In each case herein, the individual blocks within FIG. 2 which correspond to features of FIG. 1, have been labeled with reference numerals which correspond to the reference numerals previously utilized in FIG. 1. As is illustrated, day and/or night magnifying optics/sighting system 107 is utilized by the operator of rifle 100 to accurately aim the system at selected targets, as well as aiding in the identification of those targets. Inputs from the Global Positioning System (GPS) processor 110, laser rangefinder 109, azimuth and elevation sensor 111, and keypad 112 are then coupled to the core computer 102. The core computer 102 then calculates the coordinates of the selected target, utilizing the observer's coordinates, as determined by the GPS system, and the relative range, azimuth and elevation data of the target relative to the position of operator of the rifle. In this manner, target coordinate data may be mathematically resolved into an appropriate coordinate system by the core computer 102 and displayed to the operator of the rifle for review via a display.

Figure 3:
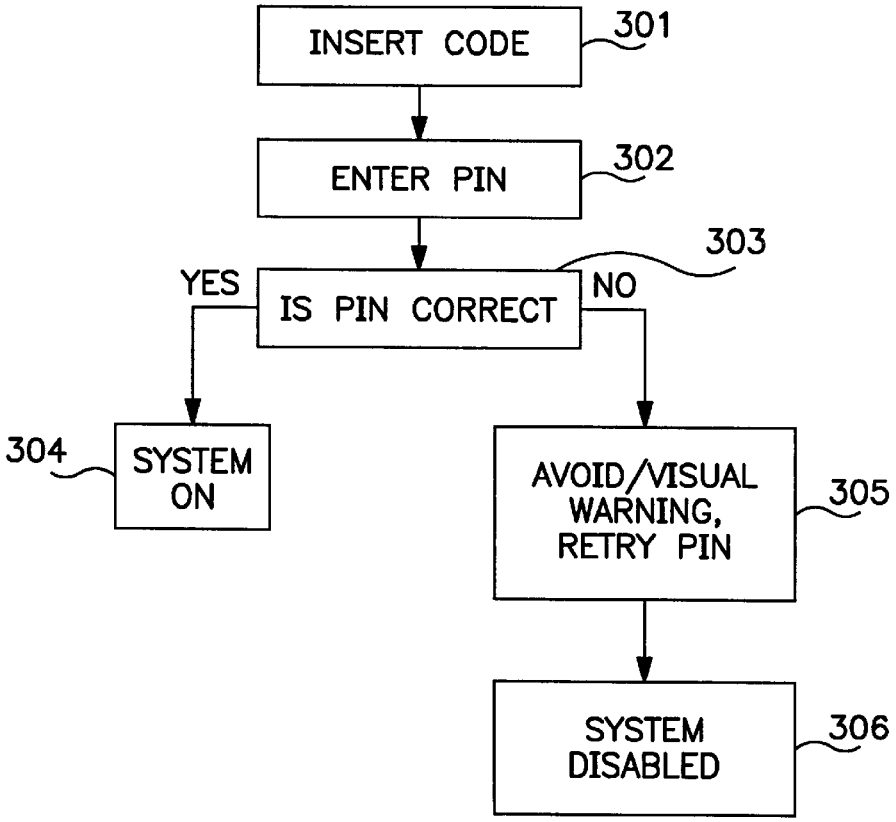
FIG. 3 illustrates an exemplary process for user authentication for the smart weapon system of the instant invention.

FIG. 3 illustrates an exemplary process for user authentication for the smart weapon system of the instant invention. At step 301, the user inserts the core computer into the weapon. The user then enters a prearranged personal identification number (PIN), step 302. At step 303, a decision is made regarding the validity of the entered PIN number. If the PIN number is accepted by the core computer, then the user is granted access to the full suite of functionality provided by the weapon, step 304. If the PIN number is not accepted, the user is notified through a plurality of means such as visual and/or audio cues, step 305. The user is preferably given three tries to enter the PIN correctly. If after the third unsuccessful attempt to correctly enter the PIN is made, the smart weapon system will be disabled and send a notification of such to the nearest command post, step 306. The weapon, however, would still be function as a conventional weapon.

The present embodiments of this invention are thus to be considered in all respects as illustrative and not restrictive; the scope of the invention being indicated by the appended claims rather than by the foregoing description. All changes that come within the meaning and range of equivalency of the claims are intended to be embraced therein.

I claim:

1. A shoulder mountable weapon system comprising:

a weapon capable of being shoulder fired including a stock, said stock enclosing and in electrical contact with a transferable core computer and physically encases said core computer;

a barrel attached to said stock, said barrel adapted to fire projectiles from said weapon; said weapon operable to fire projectiles when said core computer is not docked in said stock.

2. The weapon system of claim 1, further comprising a GPS receiver integral to the weapon.

3. The weapon system of claim 1, further comprising a laser rangefinder integral to the weapon.

4. The weapon system of claim 1, therein the weapon is selected from the group consisting of a rifle, handgun, machine gun, grenade launcher, rocket launcher, and mixtures thereof.

5. A portable weapon comprising means to discharge projectiles therefrom, a core enclosure positioned in said weapon and a core computer removably positioned in said enclosure, said core computer having means to be used in enclosures other than said weapon, said core computer not functional as a computer unless it is in electrical connection with a suitable enclosure, said core computer having the components of general purpose computer encased in a completely closed housing wherein said components cannot be replaced, tampered with or removed from said housing, wherein the portable weapon is operative as a weapon without the core computer being docked in the weapon.

6. The portable weapon of claim 5, further comprising a GPS receiver integral to the weapon.

7. The portable weapon of claim 5, further comprising a laser rangefinder integral to the weapon.

8. The portable weapon of claim 5, wherein the weapon is selected from the group consisting of a rifle, handgun, machine gun, grenade launcher, rocket launcher, and mixtures thereof.

* * * * *